US005511131A

United States Patent [19]

Kohara et al.

[11] Patent Number: 5,511,131

[45] Date of Patent: Apr. 23, 1996

[54] LOUDSPEAKER

[75] Inventors: Rintaro Kohara; Takeshi Yoshimura; Hidetoshi Shirakawa, all of Akishima, Japan

[73] Assignee: Foster Electric Co., Ltd., Tokyo, Japan

[21] Appl. No.: 277,968

[22] Filed: Jul. 20, 1994

Related U.S. Application Data

[63] Continuation of Ser. No. 68,180, May 28, 1993, Pat. No. 5,371,806.

[30] Foreign Application Priority Data

Feb. 3, 1993 [JP] Japan ..... 5-39320
Feb. 3, 1993 [JP] Japan ..... 5-39321

[51] Int. Cl.[6] ..... H04R 25/00

[52] U.S. Cl. ..... 381/192; 381/199; 381/188; 381/205; 381/194; 381/197

[58] Field of Search ..... 381/195, 199, 381/201, 202, 194, 196, 193, 192; 181/148, 197

[56] References Cited

U.S. PATENT DOCUMENTS

| | | |
|---|---|---|
| 3,201,529 | 8/1965 | Surch . |
| 4,783,824 | 11/1988 | Kobayashi . |
| 4,817,165 | 1/1987 | Amalaha . |
| 4,868,882 | 9/1989 | Ziegenbert et al. . |
| 5,062,140 | 4/1989 | Inanaga et al. . |
| 5,123,053 | 6/1992 | House . |
| 5,214,710 | 5/1993 | Ziegenberg et al. . |

*Primary Examiner*—Curtis Kuntz
*Assistant Examiner*—Sinh Tran

[57] ABSTRACT

A loudspeaker has two magnets disposed directly with respect to voice coils for generating a repulsion magnetic field at the voice coils, without interposition of yoke but with mutually repulsing magnetic polarities of the magnets, and a diaphragm directly coupled at inner peripheral edge substantially to the center of outer periphery of the voice coils. Driving force is transmitted highly efficiently from the voice coils to the diaphragm, and the loudspeaker can be sufficiently minimized in the thickness and weight.

2 Claims, 3 Drawing Sheets

LOUDSPEAKER

This application is a continuation of application Ser. No. 08/068,180, filed May 28, 1993 U.S. Pat. No. 5,371,806.

BACKGROUND OF THE INVENTION

This invention relates to loudspeakers and, more particularly, to a loudspeaker made to be thin and light with a repulsion magnetic field utilized.

DESCRIPTION OF RELATED ART

For known loudspeaker of the kind referred to, there may be enumerated ones described in Japanese Patent Publication No. 40-25922 by S. Morita, Japanese Utility Model Publication No. 2-30957 by U. Kawano, and so on, in which known loudspeakers a spacer is employed in combination with thin disk-shaped or ring-shaped permanent magnets disposed on both surfaces of the spacer to oppose their surfaces of the same polarity, so that the entire arrangement can be minimized in the thickness and weight. Further, a report titled "An Ultralight Loudspeaker With Repulsion Magnetic Field Applied" by H. Kumakura et al in JAS Conference '92 Appointed Theses, published by Nippon K. K. Kenwood, discloses a technical matter realizing the light weight loudspeaker by means of the repulsion magnetic field utilized.

In the loudspeaker of the kind referred to, generally, it has been demanded that the thinness and lightness are promoted after achieving high and sufficient improvements in the transmission efficiency of the driving force from the voice coils to the diaphragm and in the reproduced tone quality. At the foregoing known technical level, however, there has been shown no technique contributive enough for improving the driving force transmission efficiency from the voice coils to the diaphragm but only an arrangement in which the voice coils themselves or the voice coils and the diaphragm are mutually coupled through a transmission member interposed between them, so as to be the cause of a problem rendering transmission loss rather remarkable. Further, a supporting structure for the voice coils so far employed has been in the form of a so-called rolling mechanism, in which the voice coils cannot be supported at their center point, and generally the structure has involved a problem in highly improving the tone quality. For the field system with respect to the diaphragm, further, there has been employed an aspect still employing an outer yoke, i.e., a ring yoke, and this has been a restriction imposed on the thickness minimization.

SUMMARY OF THE INVENTION

Accordingly, a primary object of the present invention is to provide a loudspeaker which is capable of remarkably improving the transmission efficiency of the driving force from the voice coils to the diaphragm, effectively removing any influence of the known rolling mechanism for the voice coils, with any outer yoke made omittable while highly improving the tone quality, and sufficiently achieving the minimization in the thickness and weight.

According to the present invention, this primary object can be realized by means of a loudspeaker in which a pair of permanent magnets are disposed to mutually repulse in the magnetic polarity for forming a repulsion magnetic field in the center of a frame, voice coils wound on a coil bobbin are disposed within this repulsion magnetic field, and the voice coils are supported with respect to the frame by a supporting means wherein the pair of magnets are disposed directly with respect to the voice coils for generating the repulsion magnetic field in a yoke-less manner, and a diaphragm is directly coupled at inner peripheral edge substantially to the center of outer periphery of the voice coils.

With the above yoke-less arrangement, the loudspeaker of the present invention can be sufficiently contributive to the minimization in the thickness and weight, while the direct coupling of the voice coils to the diaphragm can remarkably reduce any drive-force transmission loss to remarkably improve the transmission efficiency, and the supporting of the voice coils at the center of the outer periphery thereof can restrain any influence of the rolling mechanism.

Other objects and advantages of the present invention shall be made clear as the description of the invention advances with reference to preferred embodiments shown in accompanying drawings.

While the present invention should be described with reference to the respective embodiments shown in the accompanying drawings, it should be appreciated that the intention is not to limit the present invention only to these embodiments shown but rather to include all alterations, modifications and equivalent arrangements possible within the scope of appended claims.

DETAILED DESCRIPTION OF THE PREFERRED EMBODIMENTS

Figure 1:
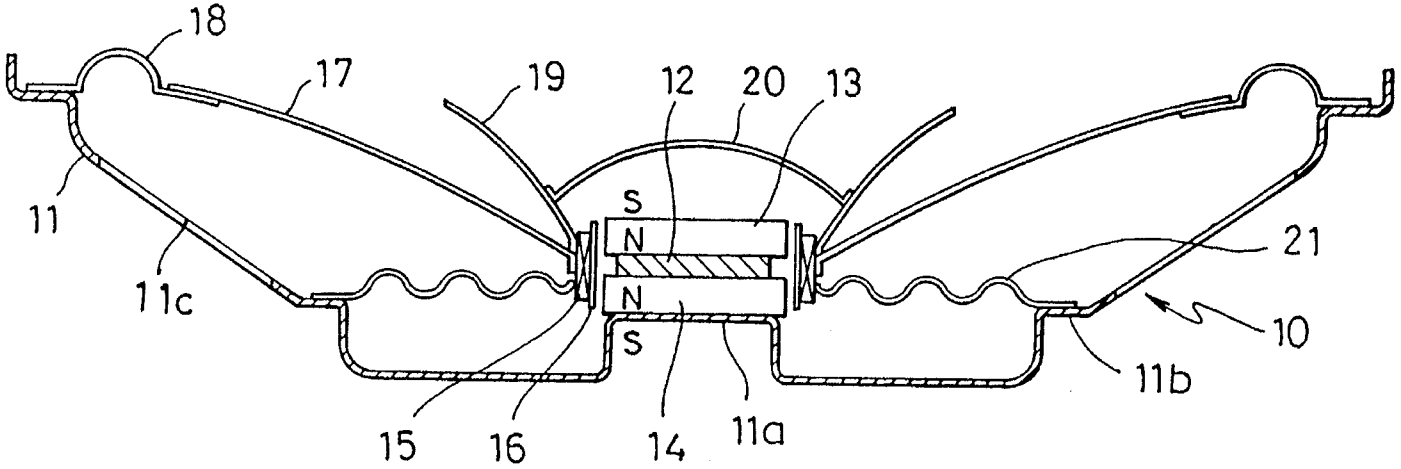
FIG. 1 is a vertically sectioned view of the loudspeaker in an embodiment according to the present invention.

In FIG. 1, there is shown an embodiment of the loudspeaker according to the present invention, in which a loudspeaker 10 comprises a generally dish-shaped frame 11 having in the central part a support mound 11*a* bulged from a bottom flat part, a support step 11*b* made substantially at an intermediate position of peripheral side part, and sound holes 11*c* made in the peripheral side part around the support step 11*b*, which part being slightly sloped towards the axis of the central support mound 11*a*, and two permanent magnets 13 and 14 are stacked on the top of the mound 11*a* with a spacer 12 interposed between them.

The magnetic 13 and 14 are formed in a disk shape and respectively magnetized to have opposite polarities in thickness direction, and are opposed to each other at mutually repulsing sides of the same polarity, e.g., N-pole sides, as spaced by the spacer 12 preferably of the same disk shape, so that a repulsion magnetic field can be provided without any yoke interposed between the magnets. While in this case the spacer 12 should preferably be prepared by such magnetic material as SS41 or the like, it is also possible to prepare the spacer with a non-magnetic material, and, when the magnets 13 and 14 are to be held in position by any other arrangement, the spacer may be replaced just by an air gap. On the other hand, the two magnets 13 and 14 should preferably be prepared by such anisotropic sintered magnet as a neodymium magnet.

Voice coils 15 are disposed within the frame 11 so as to surround the stacked magnets 13 and 14, as wound on a coil bobbin 16 axially vibratable closely about outer pheripheral edge of the disk-shaped magnets 13 and 14, that is, to be disposed within the repulsion magnetic field generated by the two magnets 13 and 14. To the center of outer periphery of the voice coils 15 on the bobbin 16, a cone-shaped diaphragm 17 is directly coupled at its inner peripheral edge defining a central opening, while the diaphragm 17 is secured at its outer peripheral edge through an edge damper 18 to the frame 11 at its portion adjacent to a top outer periphery of the frame 11. A sub-cone 19 is also directly coupled at its inner peripheral edge to the voice coils 15 at its part adjacent to the inner peripheral edge of the diaphragm 17, and a dust-preventing center cap 20 is fitted to the center of the sub-cone 19 so as to cover the magnets 13 and 14.

Further, a supporting damper 21 is secured at its inner peripheral edge to the central part on the outer periphery of the coil bobbin 16, and at its outer peripheral edge to the support step 11*b*.

Now, in the loudspeaker 10, as shown in FIG. 1, the voice coils 15 are disposed directly within the repulsion magnetic field generated by the two magnets 13 and 14 as shown in FIG. 1, without any yoke interposed, and the arrangement can be contributive to the minimization in the thickness and weight. Further, the direct coupling of the cone-shaped diaphragm 17 to the voice coils 15 is effective to teatrain any transmission loss of the drive force from the voice coils 15 to the diaphragm 17 to be the minimum, and the vibration of the diaphragm 17 can be made to faithfully rise in response to input signals to the voice coils. Further, since the support point of the voice coils 15 by the damper 21 is positioned substantially in the center of the voice coils 15, any influence of the rolling mechanism can be removed, and generally speaking the tone quality can be improved at a high degree.

Figure 2:
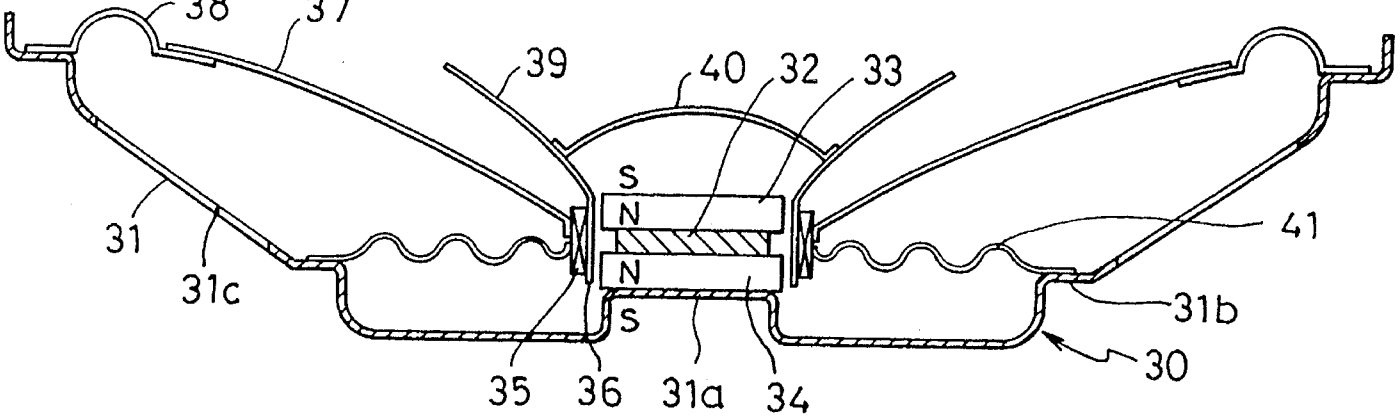
FIG. 2 shows in a vertically sectioned view another embodiment of the loudspeaker according to the present invention.

In another embodiment shown in FIG. 2, the sub-cone 39 is provided integral with the coil bobbin 36, in which event the vibration of the coil bobbin 36 on which the voice coils 35 are directly transmitted to the sub-cone 39, and the function of this sub-cone 39 can be further improved.

In the embodiment of FIG. 2, substantially the same constituents as those in the embodiment of FIG. 1 are denoted by the same reference numbers as those given in FIG. 1 but with "20" added, and other constituents and functions than described are the same as those in the embodiment of FIG. 1.

In the foregoing embodiments of FIGS. 1 and 2, it is possible to improve low frequency range. characteristics, by interposing a mechanical filter (not shown) between the voice coils 15 or 35 and the diaphragm 17 or 37.

Figure 3:
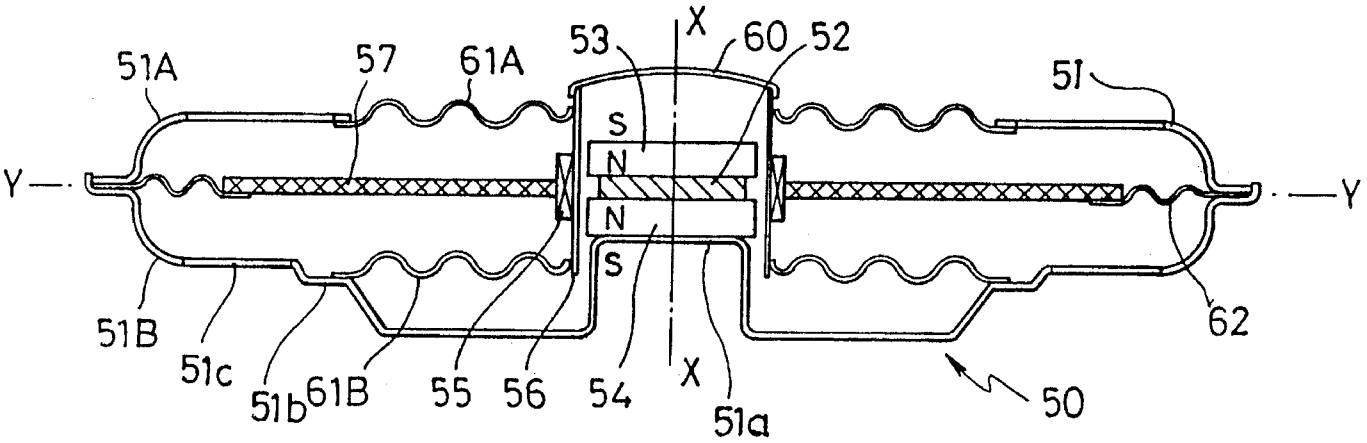
FIGS. 3 and 4 also show in vertically sectioned views further embodiments of the loudspeaker according to the present invention.

Referring next to FIG. 3, there is shown a further embodiment of the loudspeaker according to the present invention, in which loudspeaker 50 the frame 51 comprises two frame halves 51A and 51B, a lower positioned one 51B of which is formed generally in a flat dish shape, while an upper positioned one 51A to be fitted to the lower half 51B is so provided that its outer peripheral part is disposed preferably to be substantially in a plane symmetry with an outer peripheral part of the lower positioned half 51B with respect to a horizontal plane including a line Y perpendicular to the axial line X of the loudspeaker 50. The coil bobbin 56 on which the voice coils 55 are wound is formed to be elongated in the direction of the axial line X, and the voice coils 55 are wound in central part of the outer periphery of the bobbin 56, and upper and lower dampers 61A and 61B are secured at their inner peripheral edges respectively to each of both ends of the coil bobbin 56 in the axial line X.

To the center of the outer periphery of the voice coils 55, an inner peripheral edge of the diaphragm 57 of, for example, a flat and honeycomb structure is directly secured, the flat diaphragm 57 is expanded on the plane including the horizontal line Y, and the outer peripheral edge of the diaphragm 57 is secured through an edge damper 62 held between both holding edges at outer peripheries of the upper and lower frame halves 51A and 51B, while the upper and lower dampers 61A and 61B are secured at their outer peripheral edges respectively to the inner peripheral edge of the upper frame half 51A and to the support step 51*b* of the lower frame half 51B. Further, the frame halves 51A and 51B include the sound holes 51*c* made in areas adjacent to the outer periphery.

In the present embodiment, in contrast to the foregoing embodiment of FIG. 1 or 2 employing the cone shaped diaphragm 17, the two magnets 53 and 54, upper and lower dampers 61A and 61B and outer peripheral parts of the frame halves 51A and 51B are disposed substantially in the plane symmetry with respect to the flat diaphragm 57. Thus, in the present embodiment, the diaphragm 57 is directly coupled to the operational center point of the voice coils 55 and supporting system of the voice coils 55 and diaphragm 57 is made to be the plane symmetry with respect to the plane including the line Y, so that the influence of the rolling mechanism can be removed in a more excellent manner.

In the embodiment of FIG. 3, substantially equivalent constituents to those in the embodiment of FIG. 1 are denoted by the same reference numbers as those used in FIG. 1 but with "40" added, and other constituents and functions than those referred to above are the same as those in the embodiment of FIG. 1.

Figure 4:
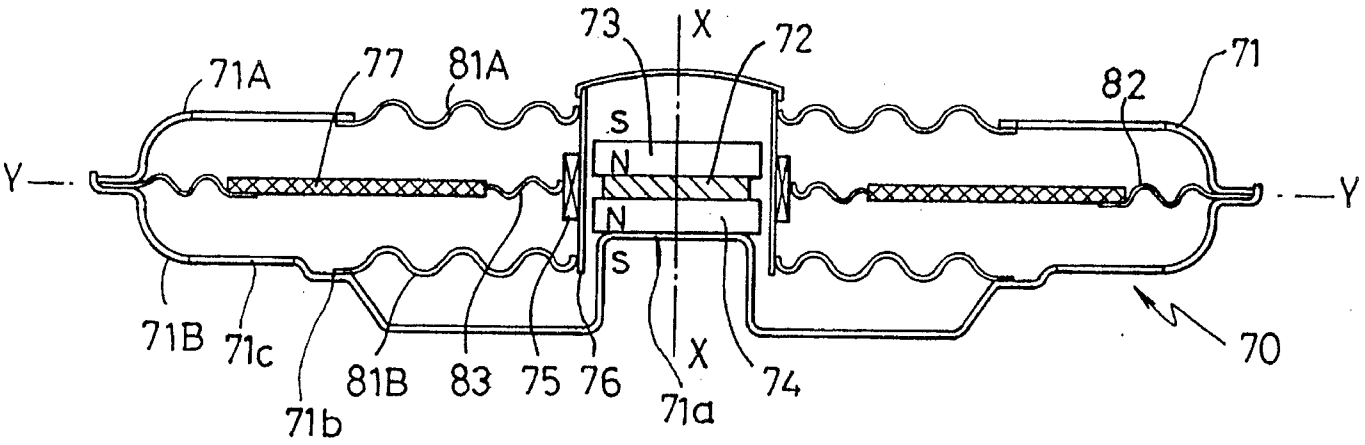

As shown next in FIG. 4 in contrast to the embodiment of FIG. 3, the flat diaphragm 77 is coupled at the inner peripheral edge through a mechanical filter 83 to the center of the voice coils 75, so that the low frequency zone characteristics can be made excellent. In this embodiment of FIG. 4, too, the equivalent constituents to those in the embodiment of FIG. 1 or 3 are denoted by the same reference numbers as those used in FIG. 1 or 3 but with "60" or "20" added, and other constituents and functions are the same as those in FIG. 1 or 3.

Figure 5:
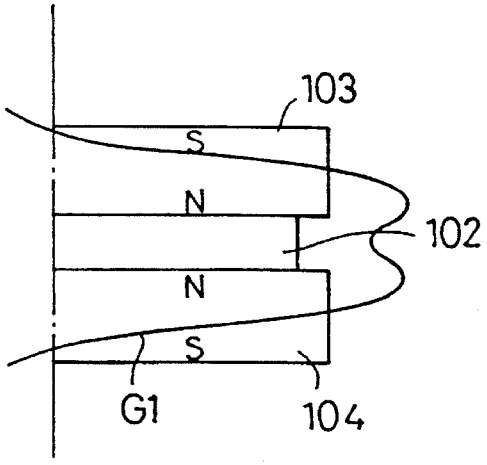
FIG. 5 is an explanatory view for the operation of magnetic circuit in the respective embodiments of FIGS. 1 to 4.

While in the foregoing embodiments the repulsion magnetic field has been disclosed to be generated by the disposition of the two disk-shaped magnets opposed at their repulsive pole surfaces of the same polarity with the spacer interposed between them, this magnetic circuit generating the repulsion magnetic field involves such magnetic flux distribution as represented by a curve G1 shown in FIG. 5 with respect to the magnetic circuit, where a leakage of flux cannot be said less, and it is intended to more improve the degree of concentration of the flux, preferably, so as to elevate the utilizing efficiency of the magnets.

Figure 6:
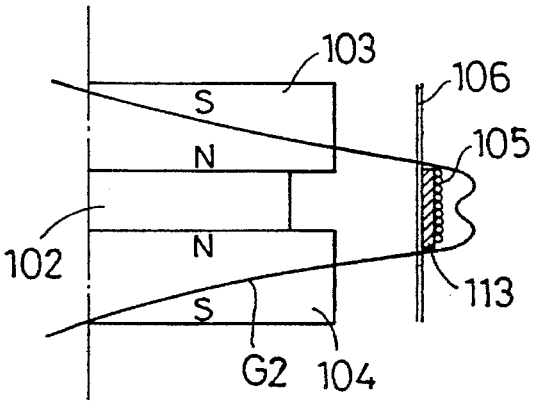
FIG. 6 is an explanatory view for a further embodiment of the present invention.

Accordingly, in a further embodiment of the present invention shown in FIG. 6, the voice coils 105 are wound on a short cylindrical magnetic sleeve 113 fixedly mounted to the central part on the outer periphery of the coil bobbin 106, whereby the magnetic flux distribution in the magnetic circuit for generating the repulsion magnetic field will be as represented by a curve G2, in which the flux concentration is elevated specifically in the flux adjacent the magnetic sleeve 113, and the utilizing efficiency of the magnetic force of the two magnets 103 and 104 can be elevated. In this case, the same operation can be achieved by forming the voice coils themselves or the coil bobbin with a magnetic material.

Figure 7:
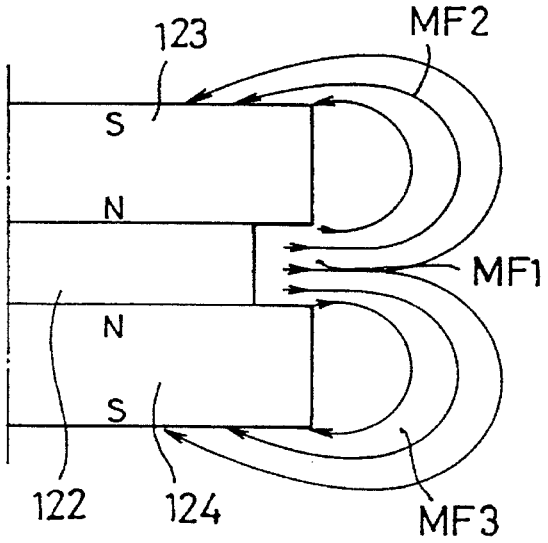
FIG. 7 is an explanatory view for the magnetic field in the respective embodiments in FIGS. 1 through 4.

In the foregoing embodiments of FIGS. 1 to 4, the repulsion magnetic field generated by the magnetic circuit of the two magnets 123 and 124 with the spacer 122 disposed between them will be as shown in FIG. 7, in which a magnetic field portion MF1 generated radially outward between both of the two magnets 123 and 124 will be of a higher intensity than that of other magnetic field portion MF2 or MF3 divided from the portion MF1 towards outer exposed pole surface of the magnet 123 or 124 radially inward. When the voice coils are wound for adaption to the radially inward magnetic field portions MF2 and MF3, a drive force by means of the radially outward magnetic field portion MF1 is not sufficiently generated in the voice coils, and it is desired to utilize effectively this magnetic field portion MF1.

Figure 8:
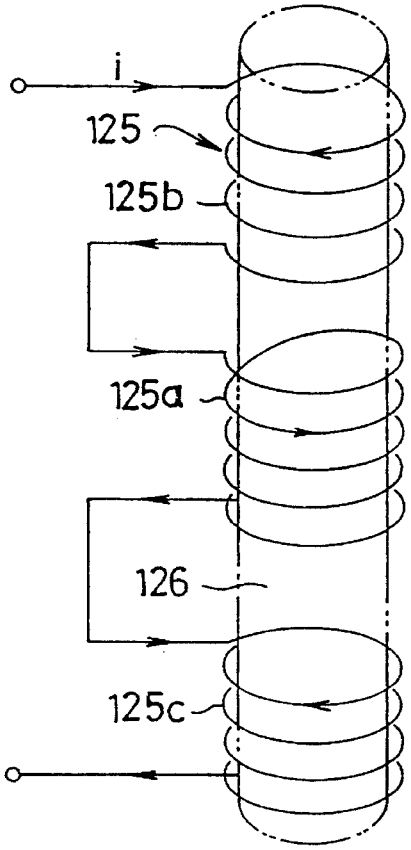
FIG. 8 is an explanatory view for still another embodiment of the present invention.

In another embodiment of the present invention shown in FIG. 8, therefore, the voice coils 125 wound on the coil bobbin 126 comprise three portions, that is, a coil portion 125*b* corresponding to the magnetic field portion MF2 of the one magnet 124, an intermediate coil portion 125*a* corresponding to the magnetic field portion MF1 between the two magnets 123 and 124, and a coil portion 125*c* corresponding to the magnetic field portion MF3 of the other magnet 124, and the respective coil portions 125*a* to 125*c* are made different in their winding direction for obtaining high drive forces with the respectively corresponding magnetic field portions MF1 to MF3, so that a clockwise drive force will be generated in the coil portions 125*b* and 125*c* as viewed in top plan view, for example, while an anti-clockwise drive force will be generated in the coil portion 125*a* between the coil portions 125*b* and 125*c*.

With this arrangement, as will be readily appreciated, the reverse directional magnetic field portion between the two magnets 123 and 124 can be effectively utilized, and a high drive force can be obtained even if the thickness and weight are intended to be remarkably minimized.

According to the present invention, various design modification can be made within the scope of appended claims. While, for example, the magnets have been described as being formed in the disk shape, the one formed in a ring shape will allow substantially the same function to be attained.

What is claimed is:

1. A flat-type loudspeaker comprising:

a magnetic drive means including a pair of disk-shaped magnets disposed to be mutually repulsive for forming a peripheral repulsion magnetic field in a yokeless manner about an axial line of the magnets, a cylindrical coil bobbin disposed coaxially closely about an outer periphery of said magnets, and voice coils wound on an outer periphery of said coil bobbin to be disposed within said peripheral repulsion magnetic field;

a planar diaphragm spread on a plane perpendicular to said axial line of said magnets, said diaphragm having a central aperture providing an inner peripheral edge and coupled at said inner peripheral edge substantially to the center of the outer periphery of said voice coil on said cylindrical bobbin;

a frame generally flat-shaped member for supporting at the center said magnets of said magnetic drive means and including an outer peripheral support part and first and second inner support edges, disposed above and below first and second surfaces of said diaphragm, respectively, the outer peripheral support supporting through an annular outer edge damper an outer peripheral edge of said planar diaphragm; and means for supporting said coil bobbin carrying said voice coils of said magnetic drive means, said supporting means including first and second annular dampers respectively spread on both sides of said diaphragm to be coaxial with said magnetic drive means and in a plane symmetrical with respect to said plane of the diaphragm, said first and second annular dampers being coupled at their inner peripheral edge to said outer periphery of said cylindrical coil bobbin at first and second axial ends of said cylindrical bobbin, respectively, and at their outer peripheral edge to the first and second inner support edges of said frame.

2. The loudspeaker according to claim 1 wherein said diaphragm is coupled at said inner peripheral edge through an annular inner edge damper to said voice coils.

* * * * *